US006854479B2

(12) United States Patent
Harwood

(10) Patent No.: US 6,854,479 B2
(45) Date of Patent: Feb. 15, 2005

(54) SUMP LINER

(76) Inventor: Alden Harwood, 74 Harding Ave., Kenmore, NY (US) 14217

( * ) Notice: Subject to any disclaimer, the term of this patent is extended or adjusted under 35 U.S.C. 154(b) by 303 days.

(21) Appl. No.: 10/227,701

(22) Filed: Aug. 26, 2002

(65) Prior Publication Data

US 2004/0035471 A1 Feb. 26, 2004

(51) Int. Cl.[7] ..... F04B 41/06; F04B 49/025

(52) U.S. Cl. ..... 137/362; 137/565.33; 137/558; 137/574; 417/5; 417/40

(58) Field of Search ..... 137/362, 558, 137/565.29, 565.33, 565.37, 574; 417/3, 4, 5, 40, 63; 52/169.5

(56) References Cited

U.S. PATENT DOCUMENTS 758,078 A * 4/1904 Jardine ..... 137/574
1,059,409 A * 4/1913 Thomas ..... 417/40
2,222,595 A * 11/1940 Regester ..... 417/5
2,265,650 A * 12/1941 Lannert ..... 137/565.33
2,569,102 A * 9/1951 Howe ..... 417/40
3,020,922 A * 2/1962 Oury ..... 137/362
3,112,760 A * 12/1963 Budd ..... 137/565.33
3,233,549 A * 2/1966 Howe ..... 417/40
3,726,606 A 4/1973 Peters
3,814,544 A 6/1974 Roberts et al.
3,972,647 A * 8/1976 Niedermeyer ..... 417/40
4,135,530 A * 1/1979 Cheney ..... 137/574
4,215,975 A 8/1980 Niedermeyer
4,437,811 A * 3/1984 Iwata et al. ..... 417/40
4,456,432 A 6/1984 Mannino
4,541,446 A * 9/1985 Hogan ..... 417/36
4,631,001 A 12/1986 Keech
5,314,313 A 5/1994 Janesky
5,836,815 A * 11/1998 Jennemann ..... 454/341
6,308,924 B1 10/2001 Janesky

* cited by examiner

*Primary Examiner*—John Rivell
(74) *Attorney, Agent, or Firm*—Hodgson Russ LLP

(57) ABSTRACT

A sump liner comprising a liner wall joined with a base member, the liner wall extending about the periphery of the base member, the liner wall comprising a primary reservoir portion and a secondary reservoir portion, with a weir extending from the base member and the inside surface of the liner wall. The weir divides the sump liner interior into a primary reservoir and a secondary reservoir, with a primary pump to remove water from the primary reservoir and a secondary pump to remove water from the secondary reservoir. The primary reservoir receives drainage water through an inlet pipe. The secondary reservoir receives drainage water that flows over the weir in the event the primary pump in the primary reservoir fails, in which case the secondary pump in the secondary reservoir pumps out the water.

29 Claims, 6 Drawing Sheets

SUMP LINER

BACKGROUND

Groundwater has been and continues to be a significant problem for buildings, especially for buildings with basements and crawl spaces. The floor of a basement typically comprises a several-inch-thick slab of concrete, poured upon a layer of crushed stone. If the surrounding water table stays below the crushed stone layer there may not be water problems in the basement. However, when the groundwater rises above the crushed stone it begins to adversely affect the building. The basement floor and basement walls become damp and/or leak. This is very undesirable. The past and present solutions to this problem are to simply collect and remove enough groundwater to keep hydraulic forces at an acceptable level. Typically, a sump located at the lowest point in a building's foundation drainage system, and a pump employed to evacuate the sump, discharging the water far enough from the building to be of no further concern.

Usually the sump is excavated at the time of the building's construction. The sump is basically a reservoir into which a cylindrical liner is placed; the liner is closed at the bottom and open at the top, and is typically constructed of polyethylene or other plastic resins. The liner defines ports along its cylindrical sidewall through which groundwater flows and collects in the reservoir. The sump liner is installed such that its open end will be flush with the adjacent finished floor. Sumps excavated subsequent to construction of the floor require removal of a sufficient amount of the floor along and underlying material to receive the liner. Then, concrete is poured around the sump liner to seal it in.

Most sump liners have inlet ports and/or are perforated for receiving drainage water from about the building's foundation footing tile drainage system through it and from groundwater beneath the basement floor. Drainage water then collects in the liner. When sufficient water has thus accumulated, a pump installed in the sump, commonly called a sump pump, is actuated and evacuates most of the water in the sump into a sewer or to a location outside the building.

Sump pumps are electromechanical in nature and consist of an impeller driven by an electric motor, all of which is contained within a housing. A float switch that closes when the water level rises to a point in the sump that would justify the energy expenditure to remove it controls operation of the pump. These switches are either separate from or integrated with the pump. The switch opens and pumping stops before the water in the sump reaches the level at which the pump can no longer function due to ingestion of air at the pump's intake. Therefore, in normal cycle duty of the sump-pumping system the pump is always at least partially immersed in water. The discharge water from the pump enters a drainage pipe or hose that leads to a location outside the building such as a field, lawn, or storm sewer.

However, as many homeowners have learned to their chagrin, sump pumps are not infallible. When a sump pump fails the first event that occurs is the sump liner overfills and floods the basement floor. The water level in the basement continues to rise until equilibrium is established, meaning the water level in the basement rises until it equals the level of the surrounding water table. This results in numerous problems for the building owner including: severe flooding inside the building, damaged or destroyed property, disagreeable odors that permeate the building, structural damage to the building, and temporary loss of use of the basement. Then, even after the basement is pumped dry, longer-lasting problems may take root including: shifting of the building's foundation, malodorous problems throughout the building, and the unhealthful growth of molds, mildews, and bacteria in the basement. All of these longer-lasting problems result in increased expense to make the building and basement habitable again and may result in decreased property value.

That every sump pump manufactured to date will fail is a statistical certainty, and therefore no pump can be depended on to function as originally designed for and unlimited amount of time. The reasons for eventual pump failure are many fold, and include at least the following: wear from friction; corrosion and electrolytic action caused by being immersed in contaminated water for its entire life, wreaking havoc on metallic surfaces; failure of seals and O-rings which results in the admission of water to components that must remain dry; accumulations of silt and other debris in the sump that can clog the pump intake, resulting in its inability to pump at the required rate, if it can pump at all; and obstructions in the discharge pipe that will disable a sump pump. Additionally, manufacturer defect in design or assembly must be recognized as a cause of pump failure.

Attempts to solve the problems associated with sump pump failure include use of a backup pump. However, the present use of backup sump pumps is not without problems. A sump liner provides for a relatively small diameter hole/opening, and to place a second pump internal to the sump is a difficult task. Additionally, complicated structural arrangements are called for when a backup sump pump is provided for in a sump liner, which necessitates use of a plurality of parts, some of which are small and intricate. There is also the high risk that separate floats for the separate pumps will become entangled, disabling both pumps. These parts must then be regularly maintained and examined since they can quickly deteriorate and become nonfunctional. Another way in which a backup pump has been used is to position a backup utility pump on the basement floor adjacent to the sump, instead of placing it within the sump liner. This also is not a satisfactory solution because not only does this arrangement present major problems in providing a reliable way to operate the pump when needed, but the backup pump is exposed to all the activities being carried out in the basement, such as people working in the basement, curious children exploring/playing in the basement, pets, and so forth. There is a high probability that one or more of these factors will conspire to render the backup pump inoperative without the knowledge of the building owner. If this happens, the backup sump pump will be of no use if the primary sump pump fails. In addition, such an exposed backup pump is constantly visible and is therefore aesthetically unappealing.

Thus, there is a need for a better sump liner, methodology, and system for preventing flooded basements and the damage associated therewith that is reliable and easy to use, yet overcomes the numerous problems and shortcomings associated with the above-described sump pump arrangements.

SUMMARY

The present sump liner advantageously defines a primary reservoir into which a primary sump pump is positioned and a secondary reservoir into which a secondary sump pump is positioned, with a weir separating the primary and secondary reservoirs. Under normal conditions, drainage water enters only the primary reservoir and is pumped out of the sump liner by the primary pump, while in the dry secondary reservoir the secondary pump remains in a brand-new "out of the box" condition. When the primary pump fails, the water will rise to the top of and flow over the weir into the secondary reservoir where the secondary sump will be activated by the high water levels acting upon its float switch, and it will pump the water out of the sump liner. This sump liner thus allows for superior and reliable removal of drainage water.

The sump liner comprises a base member, a liner wall comprising a proximal end and a distal end, with the proximal end joined with the base member. The liner wall extends about the periphery of the base member with the liner wall and the base member defining a sump liner interior therein. The liner wall comprises an inside surface and an outside surface. The liner also comprises a primary reservoir portion and a secondary reservoir portion. The primary reservoir portion surrounds the primary reservoir and the secondary reservoir portion surrounds the secondary reservoir. The primary reservoir portion allows drainage water to pass therethrough. To accomplish this, the primary reservoir portion of the liner wall may define an inlet pipe(s) opening and/or perforations, while the secondary portion or the liner wall has no such openings and is impermeable.

A weir extends from the base member and from the inside surface of the liner wall, the weir dividing the sump liner interior into a primary reservoir and an adjacent secondary reservoir. The height of the weir is less than the height of the liner wall. The primary reservoir is thus bounded by the primary reservoir portion of the liner wall, the base member and the weir; and the secondary reservoir is thus bounded by the secondary reservoir portion of the liner wall, the base member, and the weir. Drainage water is discharged out of the primary sump by the pump housed therein during normal operation while the secondary reservoir remains dry.

When the primary sump pump fails the drainage water will rise and flow over the weir into the secondary reservoir where it is pumped out of the sump liner by the secondary sump pump. The secondary sump pump is always in a new, "out of the box" condition (or certainly can be depended on to be in an "as last used" condition) and serves as an extremely reliable backup. Other advantages of the sump liner are that it allows the secondary sump pump to be stowed in a safe and dry environment until called upon to pump. This allows for the facilitated inspection and maintenance of the secondary pump. A lid is provided to cover the sump liner and to direct any water on the surrounding basement floor into the primary reservoir, excluding its admission to the secondary reservoir.

The presence of the secondary sump in place, ready to operate when needed, and preserved in original condition provides the owner not only with a heightened sense of security, but relieves of him or her of the pressures of the emergency presented with the discovered failure of a solitary pump. Even in the event that the owner may have anticipated the failure of the sump pump and has a spare on hand, its installation during a flood is difficult and unpleasant. The present sump liner provides for continuous and uninterrupted operation of the groundwater-removal system. Backup or auxiliary sump pumps, when they are activated, often leave no evidence of that event, and the owner would be unaware that it had been called to duty unless he or she actually observed that event. If the building owner observes water in the secondary liner, then she or he knows the primary pump failed and/or could not adequately handle the volume of inflowing water. The building owner can then investigate the primary pumping system, and can repair and/or replace the primary pump if necessary, and in a non-emergency mode.

Additionally, a simple low cost water alarm is positionable in the secondary reservoir. The alarm sounds upon contact with water, and continues to sound until reset. This forces the building owner to investigate, and drain and dry the secondary reservoir. The secondary reservoir and associated secondary pump are in this manner always kept in good working order.

DESCRIPTION

Figure 3:
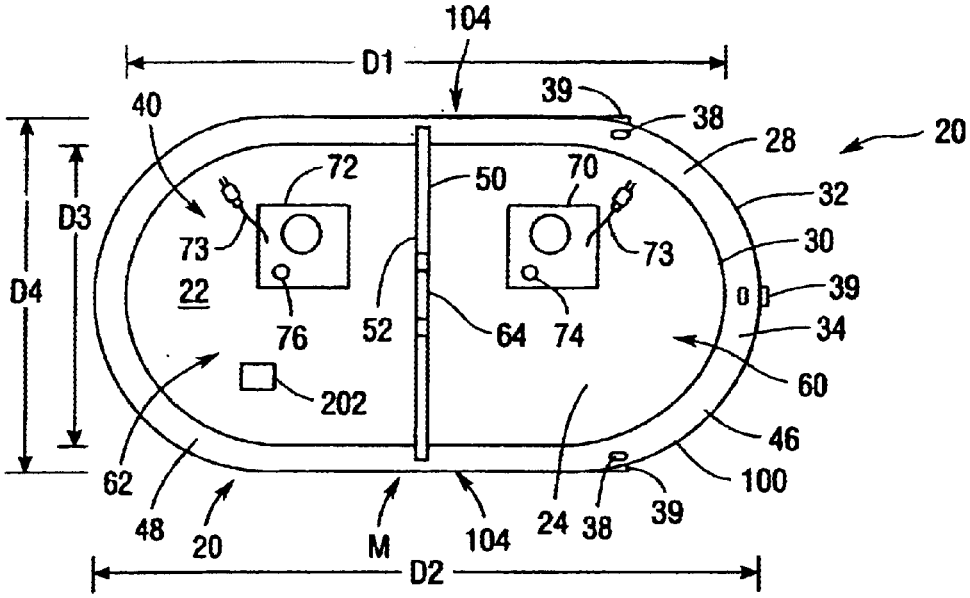
FIG. 3 is a top plan view of the sump liner.

The sump liner 20 collects drainage water from under a building's basement floor 200 (FIG. 1) and from about a building's foundation. The sump liner 20 comprises a liner wall 28 that extends about the perimeter of a base member 22. The liner wall 28 and base member 22 define a sump liner interior 40. The liner wall 28 comprises a primary reservoir portion 46 and a secondary reservoir portion 48. The sump liner 20 comprises a dam or weir 50 which is positioned in the sump liner interior 40 and divides the sump liner interior 40 into a primary reservoir 60 and a secondary reservoir 62 (FIG. 3). A primary sump pump 70 is provided for in the primary reservoir 60 and a secondary sump pump 72 is provided for in the secondary reservoir 62. These pumps 70, 72 receive electrical power through power cords 73. Drainage water (water) enters the primary reservoir 60 through one or more inlet pipes 39 extending though cutouts 38 defined in the primary reservoir portion 46 liner wall 28. In other embodiments the cutouts 38 may be replaced by or used in combination with perforations (not shown in the drawings) defined in the primary reservoir portion 46 of the liner wall 28. The drainage water is then pumped out of the primary reservoir 60 through discharge pipe 74. Meanwhile, the secondary sump pump 72 in the secondary reservoir 62 remains in a brand-new "out of the box" (or known to be in good) condition as the secondary reservoir 62 is dry. If the primary sump pump 70 fails or breaks down, the drainage water continues to enter the primary reservoir 60. The water level in the primary reservoir 60 rises until it reaches the top of the weir 50, at which point the drainage water spills over the weir 50 and into the secondary reservoir 62, where it may activate a water sensitive alarm 202 positioned in the secondary reservoir 62.

The water level rises in the secondary reservoir 62 and continues to rise until it activates the secondary sump pump 72, at which point the secondary sump pump 72 pumps the drainage water through its discharge pipe 76 and the drainage water exits the sump liner 20. The sump liner 20 advantageously allows for a secondary sump pump 72 in "out of the box" condition (or known to be in good working order) to start pumping whenever it is called upon. Thus, the sump liner 20 is a superior advance in that its configuration guarantees that a dry secondary sump pump 72, safely stowed in an out of the way location, is already connected to discharge piping, is energized, and is immediately available to start pumping drainage water from the sump liner.

Figure 1:
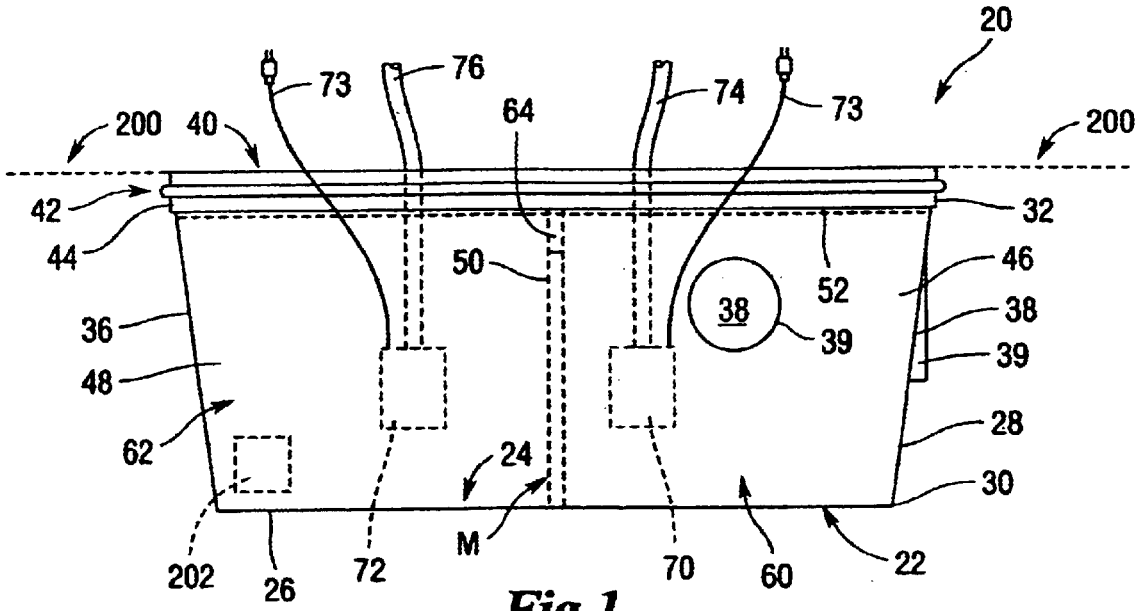
FIG. 1 is a frontal side elevational view of the sump liner.

Turning to the sump liner 20 shown in the side elevational view of FIG. 1, the sump liner 20 comprises a base member 22 comprising a top side 24 and a bottom side 26. As shown in the top plan view of FIG. 3 the base member 22 comprises an elongated elliptical shape. The sump liner 20 further comprises a liner wall 28 which comprises a proximal end 30 and distal end 32. The proximal end 30 of the liner wall 28 comprises an elongated elliptical shape and comprises length designated D1 and a width designated D3, as shown in FIG. 3. The proximal end 30 of the liner wall 28 is joined with the top side 24 of the base member 22. The distal end 32 of the liner wall 28 also comprises an elongated elliptical shape and comprises a length designated D2 and a width designated D4, as shown in FIG. 3. The liner wall 28 also comprises a primary reservoir portion 46 and a secondary reservoir portion 48. Thus, the primary reservoir 60 is bounded by the base member 22, the primary reservoir portion 46 of the liner wall 28, and the weir 50; and the secondary reservoir 62 is bounded by the base member 22, the secondary reservoir portion 48 of the liner wall 28, and the weir 50. Additionally, the secondary reservoir portion 48 of the liner wall 28 is impermeable so groundwater does not seep therethrough and enter the secondary reservoir 62 in that manner. This ensures the secondary reservoir 62 stays dewatered until water flows over the weir 50.

Figure 2:
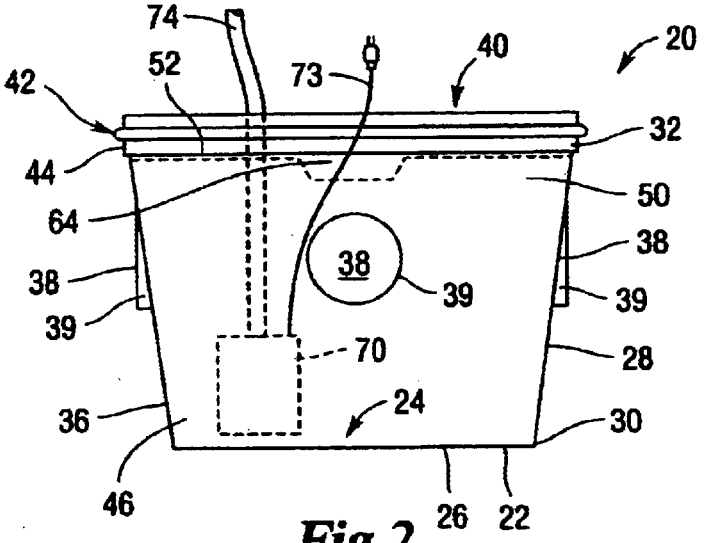
FIG. 2 is an end elevational view of the sump liner.

As shown in FIGS. 1 and 2, D2 is greater than D1, and D4 is greater than D3, so that the liner wall 28 takes on a truncated conical shape. Alternatively, D3 and D4 may be equal to one another and D1 and D2 may be equal to one another in which case the liner wall 28 takes on an oblong cylindrical shape. In other embodiments, the liner wall may comprise a cylindrical shape.

Figure 7:
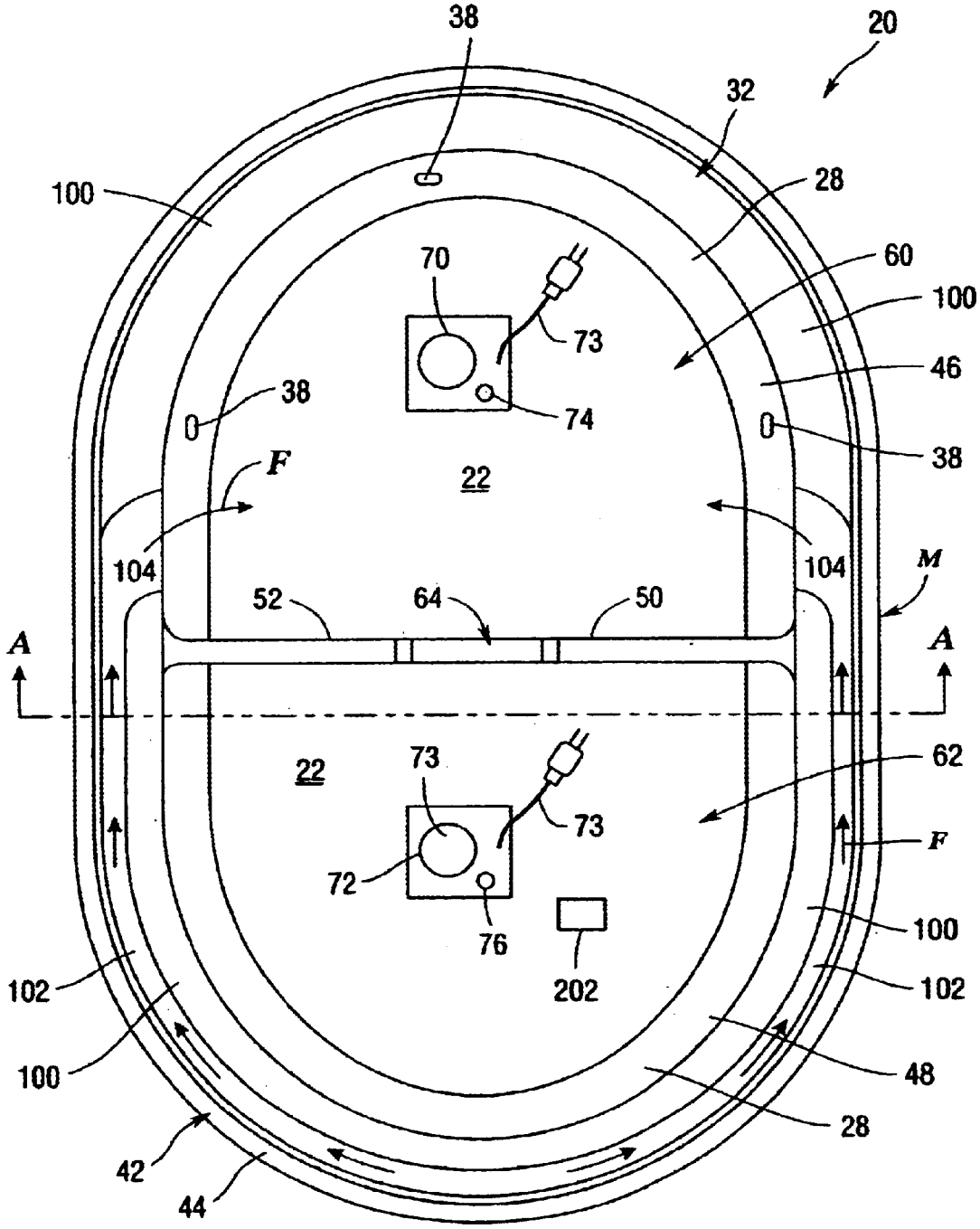
FIG. 7 is an expanded top plan view of the sump liner of FIG. 3 showing the lid support surface and gutter in greater detail (no lid on sump liner).
Figure 8:
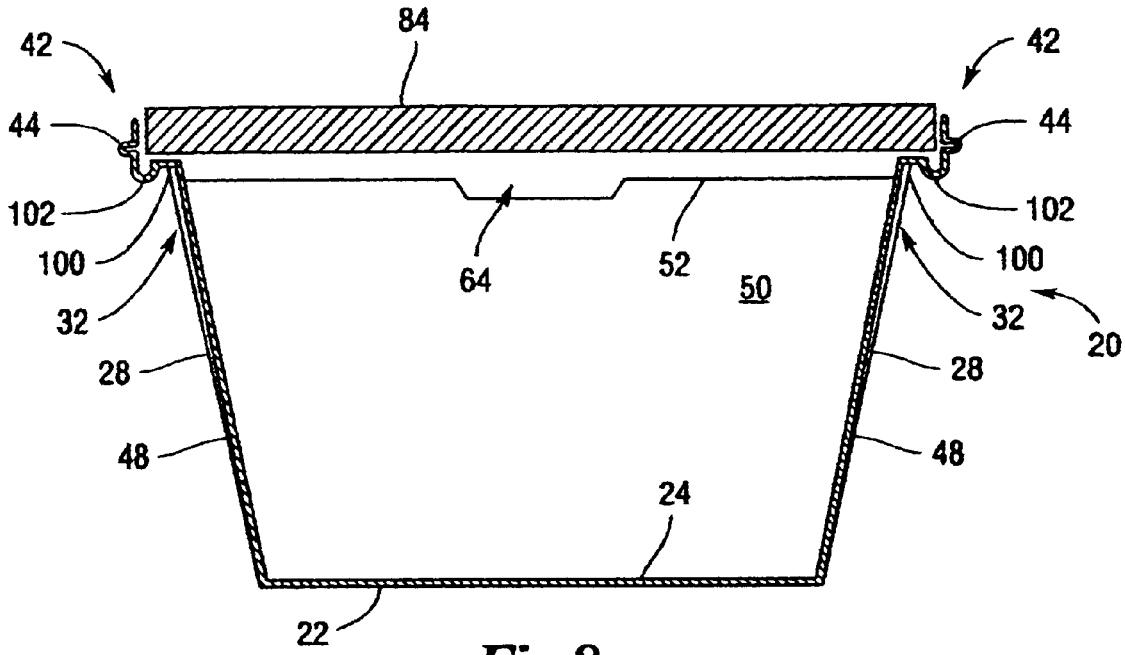
FIG. 8 is a side elevational sectional view of the sump liner and lid taken along cut line A—A of FIG. 7 (lid shown for illustrative purposes).

The liner wall 28 further comprises an inside surface 34 and an outside surface 36. Inlet pipes 39 extend through cutouts 38 defined in the primary reservoir portion 46 of the liner wall 28 which allow drainage water to pass therethrough and enter the sump liner's 20 primary reservoir 60. In other embodiments, the primary reservoir portion 46 of the liner wall may define perforations (not shown) alone or in combination with the inlet pipes 39 allowing water to enter the primary reservoir 60. The secondary reservoir portion 48 of the liner wall 28 is impermeable so that surrounding groundwater does not seep therein. This keeps the secondary reservoir 62 dry so that the secondary reservoir 62 fills only with water that flows over the weir 50. Also, in the vicinity of the distal end 32 of the liner wall 28 is a means for keying and/or securing 42 the sump liner 20 to the basement floor 200 which, as shown in FIGS. 1, 7–8, comprises a protruding lip 44 that extends about the periphery of the sump liner's 20 outside surface 36. The means for keying 42 prevents hydraulic forces generated by surrounding ground water from lifting the sump liner 20 above the basement floor 200.

Figure 4:
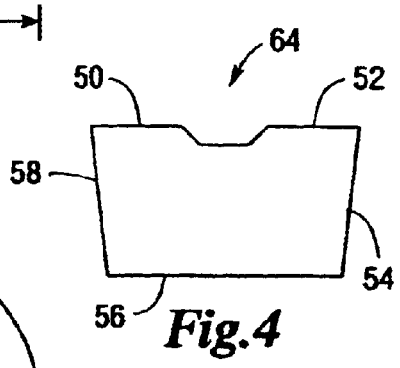
FIG. 4 is a side elevational view of the weir.

The dam or weir 50 comprises a first side 52, a second side 54, a third side 56, and a fourth side 58 and is sized so as to be receivable in the sump liner 20 interior 40. The weir 50 makes contact with the inside surface 34 of the sump liner 20, as shown in FIGS. 3 and 4. Also, the weir 50 extends from the base member 22 and the inside surface of the liner wall 34 at the location designated M in FIGS. 1 and 3. Location M is where the primary reservoir portion 46 of the liner wall 28 and the secondary reservoir portion 48 of the liner wall 28 meet and may serve as a midpoint of the sump liner 20. The weir 50 thus divides the liner interior 40 into the primary reservoir 60 and secondary reservoir 62. If the sump liner 20 is formed as a unitary body, then the weir 50 merges with the inside surface 34 of the liner wall 28, that is, the second side 54, third side 56, and fourth 58 side of the weir 50 are joined with the inside surface 34 of the liner wall 28. The weir 50 extends from the base member 22 to substantially the distal end 32 of the liner wall 28. The first side 52 of the weir 50 also defines a spill-way 64, the utility of which to be described presently. Alternatively, the weir may be embodied such that the first side 52 is recessed with respect to the distal end 32 of the liner wall 28 in which scenario the spill-way 64 is optional. A water sensitive alarm 202 may be provided which is positionable in the secondary reservoir 62.

A primary sump pump 70 is provided for in the primary reservoir 60 and a secondary sump pump 72 is provided for in the secondary reservoir 62. The primary and secondary sump pumps 70, 72 may be identical standard electric sump pumps each comprising a switch, a motor, a pump, and a float (not show in drawings). When the water level rises the float moves upwardly, closes the switch, and activates the motor. This activates the primary sump pump 70 or secondary sump pump 72, as the case may be. It is noted that the primary sump pump 70 and secondary sump pump 72 may comprise internal check valves so that water does not backflow down the discharge pipes 74, 76 respectively and back into the sump liner 20.

Figure 5:
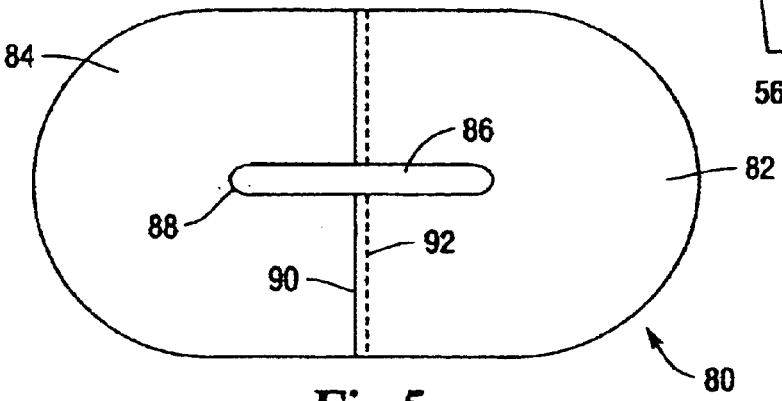
FIG. 5 is a top plan view of the lid.
Figure 6:
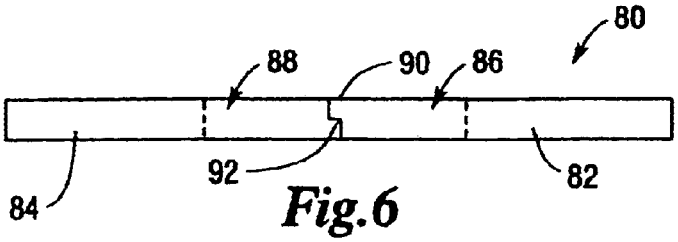
FIG. 6 is a side elevational view of the lid.

A lid 80 is provided for, sized so as to be fittable over the sump liner's 20 primary reservoir 60 and secondary reservoir 62, the lid 80 is shown in FIGS. 5 and 6. The lid 80 comprises a primary half 82 for covering the primary reservoir 60 and a secondary half 84 for covering the secondary reservoir 62. The primary and secondary lid halves 82, 84 may be such that the primary half 82 has a lip 90 which rests on a protrusion 92 extending from the secondary half 84, as seen in FIG. 6. The primary lid half 82 defines a primary lid opening 86 and secondary lid half 84 defines a secondary lid opening 88, these primary and secondary lid openings 86, 88 for allowing discharge pipes 74, 76 to pass therethrough, as shown in FIGS. 1, and 5–6. In other embodiments, the weir 50 may be embodied so as to be sufficiently wide so that the primary lid half 82 and secondary lid half 84 comprise abutting flat faces (the lip 90 and protrusion 92 are absent) and both rest on the first side 52 of the weir 50 with the weir 50 providing support. This embodiment is not shown in the drawings.

The distal end 32 of the liner wall 28 comprises a surrounding support surface 100 which supports the lid 80 when the lid 80 is placed thereon. The support surface 100 is shown in FIGS. 3 and 7–8, FIG. 7 showing an enlarged top plan view of FIG. 3. FIG. 8 shows a side elevational sectional view of the sump liner 20 along cut line A—A of FIG. 7. It is noted that FIG. 8 also shows a sectional view of the secondary half 84 of the lid 80 for purposes of illustration, that is, to show how the lid 80 is supported by the support surface 100.

As shown in FIG. 7, the support surface 100 extends about the periphery of the distal end 32 of the liner wall 28. The support surface 100 defines a gutter 102 about the periphery of the secondary reservoir portion 48 of the liner wall 28 (FIG. 7). The gutter 102 not only surrounds the secondary reservoir portion 48, but it extends past the weir 50 and past the midpoint designated M, as seen in FIG. 7. The gutter 102 then leads to a gutter outlet 104 which allows flow from the gutter to enter into the primary reservoir portion 46, as shown in FIGS. 3 and 7. The gutter 102 collects and moves water which flows into it from the surrounding floor 200 In particular, the water in the gutter 102 flows in the direction of the arrows, indicated by the reference letter F, through the gutter 102 and out the gutter outlet 104 spilling into the primary reservoir 60. The gutter 102 keeps water out of the secondary reservoir 62 by directing any water that enters it to flow into the primary reservoir 60. The gutter 102 thus keeps the secondary reservoir dry 62.

Figure 9:
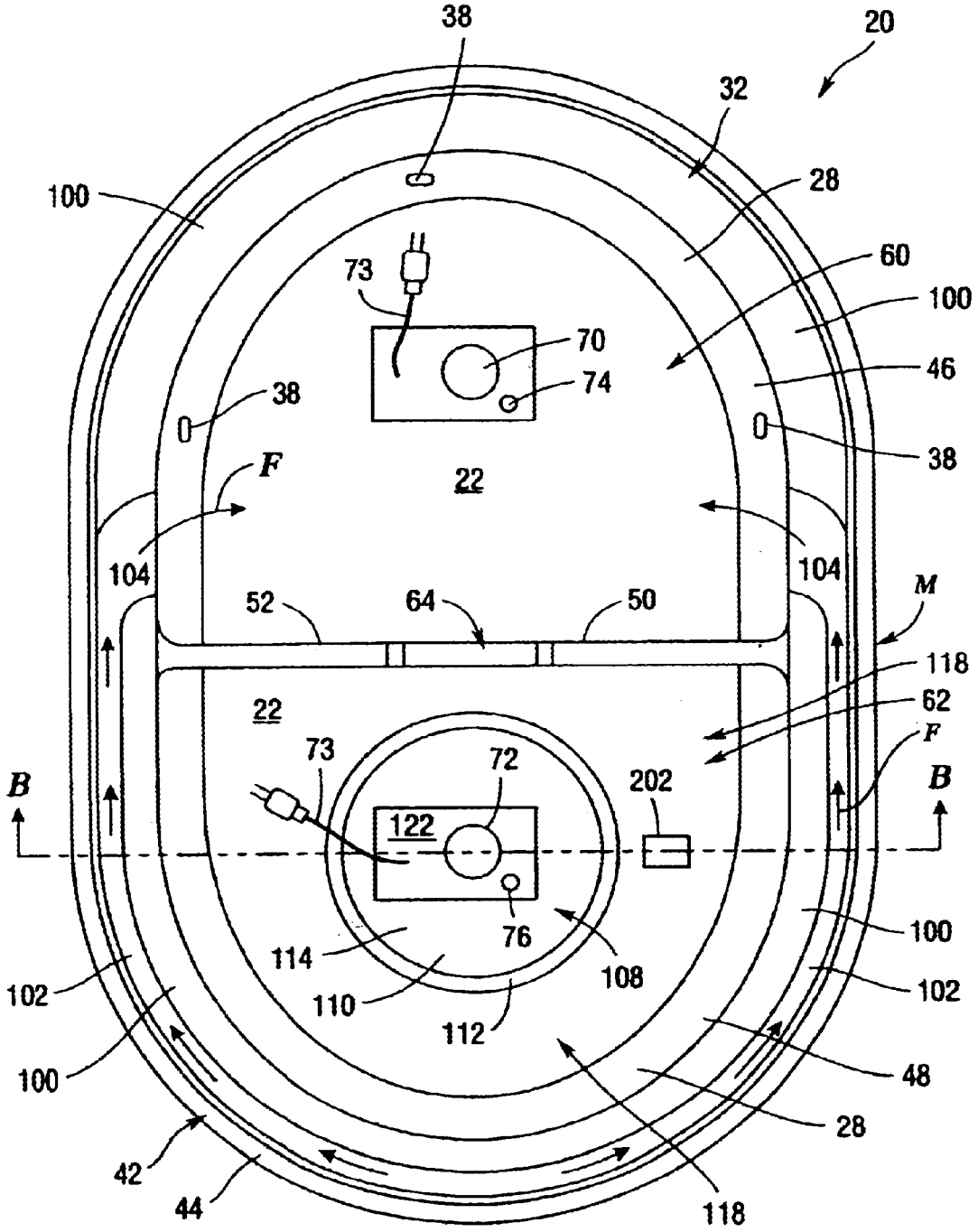
FIG. 9 is a top plan view of a second embodiment of the sump liner (no lid).
Figure 10:
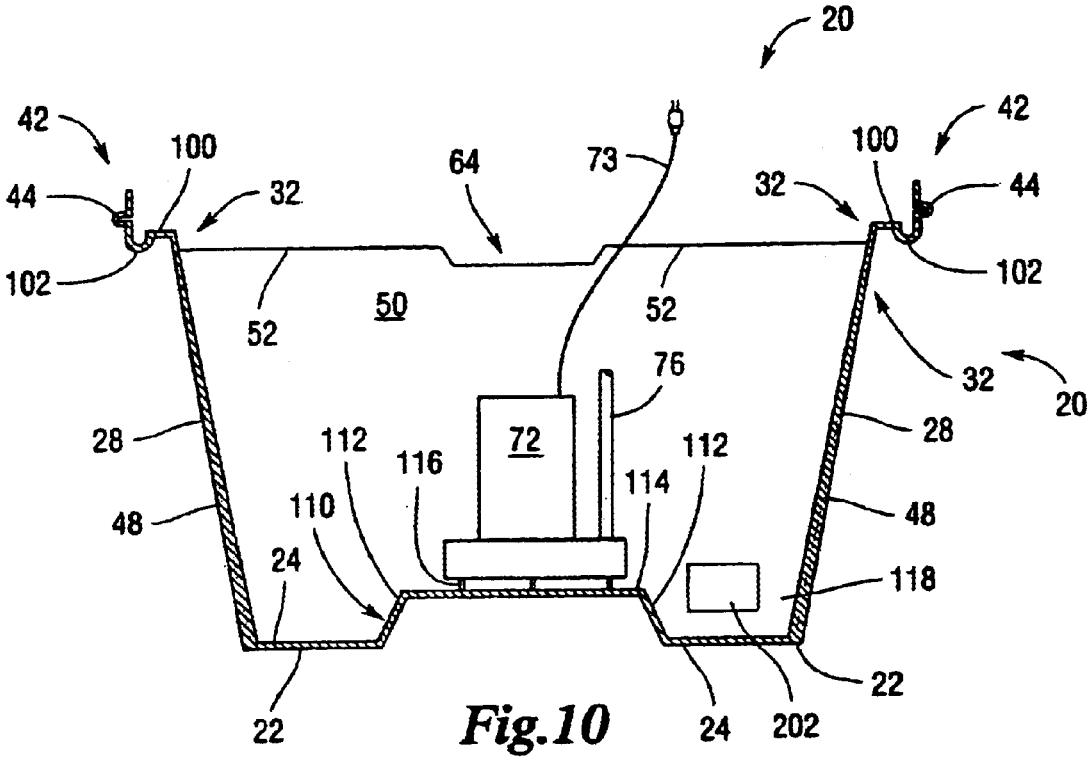
FIG. 10 is a side elevational sectional view of the second embodiment of the sump liner taken along cut line B—B of FIG. 9.

In a second embodiment of the sump liner 20, shown in FIGS. 9 and 10, there is provided a means for elevating 108 the secondary pump 72 in the secondary reservoir 62, useful in situations wherein the gutter 102 is overloaded with incoming water. FIG. 9 shows a top plan view of this embodiment, and FIG. 10 shows a side elevational sectional view of this embodiment taken along cut line B-B of FIG. 9. Turning to FIG. 9, the elevation means 108 comprises a base member 22 comprising a riser 110, the riser 110 comprising a riser wall 112 which supports the elevated platform 114. The secondary sump pump 72 is supported by legs 116 (FIG. 10) and is placed on the elevated platform 114. The elevated platform 114 allows for a surrounding water basin 118 to be defined in the secondary reservoir 62, shown in FIG. 10. In particular, the water basin 118 is defined between the elevated platform's riser wall 112, the weir 50, the surrounding secondary reservoir portion 48 of the liner wall 28, and the top side 24 of the base member 22.

The water basin 118 is a superior design, as it advantageously allows for the secondary pump 72 to remain elevated above any water which seeps into the secondary reservoir 62. Water may seep into the secondary reservoir if the gutter 102 is overloaded with drainage water from the surrounding floor 200, or if the gutter outlet 104 is overloaded. The elevated platform 114 keeps the secondary pump 72 above this seepage water. Further this seepage water will collect in the water basin 118 and activate the alarm 202. Thus, the water basin 118 keeps the secondary pump 72 in "out of the box" condition even if small amounts of water seep into the secondary reservoir 62. Of course, if mass quantities flow into the secondary reservoir 62 in the event of primary pump 70 failure or overload, the secondary pump 72 will commence pumping as soon as the surrounding water level rises high enough to activate the pump 72. Thus, one of the advantages of the water basin 118 is that in the event of small see pages of water in to the secondary reservoir 62, the secondary pump 72 will not be exposed to the deleterious effects of this water, meaning the secondary pump 72 remains in a pristine condition for future use. Yet another advantage of the second embodiment of the sump liner 20 is that the previously described lid 80 may be readily positioned on it. Another advantage is that the means for elevating 108 are shaped so as to allow for the stacking of the sump liners 20. This results in facilitated transportation and storage of the sump liners 20. Such stacking of the sump liners may similarly be done in the first embodiment.

Installation and Operation

To install the sump liner 20 a hole of sufficient size is made in the concrete basement floor 200 and the sump liner 20 is inserted therein such that it is substantially flush with the basement floor 200. Next mortar and/or concrete are filled in around the sump liner 20 and the means for keying 42 which secures the sump liner 20 to the basement floor 200. If the building is being constructed the sump liner 20 may be inserted into a defined sump hole prior to pouring the concrete basement floor 200, in which case the concrete could be poured around an already positioned sump liner 20 and means for keying 42. This obviates the need for making a hole in the basement floor 200. In any event, the sump liner 20 is positioned in the hole and fixed therein by way of pouring concrete/mortar around the sump liner 20 and leveling the concrete/mortar substantially flush with distal end 32 of the liner wall 28. The sump liner 20 is thus fixed to the basement floor 200 so that it is immovable by hydraulic forces imposed by ground water.

In use, drainage water flows through the inlet pipes 39 (and/or perforations) that pass through the liner wall 28 and from there into the primary reservoir 60. Drainage water from the gutter 102 will also flow into the primary reservoir 60 through the gutter outlet 104. When the water level rises sufficiently, the primary sump pump 70 activates and pumps the drainage water out of the sump liner 20 through discharge pipe 74 and out to a desired location such as a field or sewer. In the event of a failure of the primary sump pump 70, that is the primary sump pump 70 can no longer remove incoming water quickly enough or cannot remove incoming water at all, the water level rises in the primary reservoir 60. The water level continues to rise until it flows over the weir 50 moving through the spill-way 64. In other embodiments of the weir 50 wherein the first side 52 of the weir 50 is recessed with respect to the distal end 32 of the liner wall 20 and no spill-way 64 is provided for, the water simply flows over the first side 52 of the weir 50.

Once the drainage water flows over the weir 50, it fills the previously dry secondary reservoir 62 with water. A water-activated alarm 202 which may be present in the secondary reservoir 62 activates upon contact with the drainage water alerting the building owner of primary sump pump 70 failure. Then, when the water level is sufficiently high, the secondary pump 72, which is in "out of the box" new condition (or known to be in good working order), pumps the water through its discharge pipe 76 and out of the sump liner 20. The building owner is thus protected against primary sump pump 70 failure in a most reliable manner, because the secondary sump pump 72, preserved pristine condition in the secondary reservoir 62, is already connected to discharge plumbing, is energized and is immediately ready to pump. Additionally, the secondary sump pump 72 may be battery-powered or powered by the building's electrical system, or powered from the buildings municipal water connection.

The operation of the second embodiment which comprises the means for elevating 108 is described above.

The building owner saves time, money, and an untold amount of grief, as the sump liner 20 provides for a secondary reservoir 62 for stowing a clean, new, and reliable secondary sump pump 72. The present sump liner 20 is thus a superior advance over past sump liners in which one or more pumps are tightly packed and could interfere with one another and wherein the backup pumps in the sump are constantly exposed to the deleterious effects of long-term immersion in water such that they may malfunction when called upon to pump. The present sump liner is also superior to the past attempts at providing a backup sump pump because the secondary sump pump 72 is safely stowed in a dry and clean environment in the secondary reservoir 62 and is readily accessible for inspection and/or replacement by merely lifting the secondary lid half 84. The present sump liner 20 is also beneficial to the building owner's state of mind because the building owner knows that a brand new "out of the box" (or known to be in good working order)

secondary sump pump 72 is always ready to start pumping drainage water.

The sump liner 20 and lid 80 may be manufactured from the following materials comprising: plastics, thermoformed plastics, injection molded plastics, metals, ceramics, and combinations thereof. Furthermore, the sump liner 20 may be a molded unitary body, and the primary and secondary lid halves 82, 84 may also be a molded as unitary bodies. This allows for the stackability and thus easy transport of the sump liners 20. Additionally, because the sump liner 20 and lid 80 may be cast in molds and because of economies of scale both the sump liner 20 and lid 80 may be quickly mass produced at low production cost.

It is to be understood that various changes in the details, parts, materials, steps, and arrangements, that have been described and illustrated herein in order to describe the nature of the sump liner, may be made by those skilled in the art within the principles and scope of the present sump liner. While embodiments of the sump liner are described, that is for illustration, not limitation.

What is claimed:

1. A sump liner comprising:

a) a base member;

b) a liner wall comprising a proximal end and a distal end, the proximal end joined with the base member;

c) the liner wall joined with and extending about the periphery of the base member, the liner wall and the base member defining a sump liner interior therein;

d) the liner wall comprising an inside surface and an outside surface;

e) a weir, the weir positioned in the sump liner interior and joined with the base member and the inside surface of the liner wall, the weir dividing the sump liner interior into a primary reservoir and an adjacent secondary reservoir; and f) wherein the liner wall further comprises a primary reservoir portion and an impermeable secondary reservoir portion, the primary reservoir portion of the liner wall defining a cutout for allowing groundwater to flow through and enter the primary reservoir, the weir for controlling the flow of water into the secondary reservoir.

2. The sump liner according to claim 1 further comprising:

a) a support surface joined with the distal end of the liner wall and wherein the liner wall comprises a periphery, the support surface extending about the periphery of the liner wall; and b) wherein the support surface defines a gutter, the gutter extends about the periphery of secondary reservoir portion of the liner wall and beyond the weir and ends at a gutter outlet, the gutter outlet leads to the primary reservoir so that water in the gutter flows out the outlet and into the primary reservoir.

3. The sump liner according to claim 1 wherein the weir comprises a first side the first side being recessed with respect to the distal end of the liner wall so that drainage water is flowable over the first side of the weir before the drainage water overflows the distal end of the liner wall.

4. The sump liner according to claim 1 wherein the cutout comprises a plurality of perforations.

5. The sump liner according to claim 1 wherein the weir further comprises a first side, the first side defining a spill-way for allowing drainage water to flow out the primary reservoir and into the secondary reservoir.

6. The sump liner according to claim 1 further comprising an inlet pipe positionable in the cutout in the primary reservoir portion of the liner wall, the inlet pipe in fluid communication with groundwater external to the primary reservoir, the inlet pipe for allowing groundwater to pass therethrough and into the primary reservoir.

7. The sump liner according to claim 1 further comprising a means for keying the sump liner to a basement floor, the means for keying for preventing groundwater hydraulic forces from moving the sump liner and further comprising a water activated alarm positionable in the secondary reservoir for alerting when water enters the secondary reservoir.

8. The sump liner according to claim 1 wherein the liner wall comprises a first length and a first width at its proximal end where it joins with the base member, and a second length and a second width at its distal end, wherein the first length equals the second length and the first width equals the second width, such that the liner wall comprises an oblong cylindrical shape.

9. The sump liner according to claim 1 wherein the liner wall comprises a first length and a first width at its proximal end where it joins with the base member, and a second length and a second width at its distal end, and wherein the first length is less than the second length and the first width is less than the second width, such that the liner wall comprises an truncated conical shape.

10. The sump liner according to claim 1 wherein the shape of the sump liner wall is selected from the group of shapes comprising: cylindrical, oblong cylindrical, and truncated conical.

11. The sump liner according to claim 1 further comprising a lid, the lid comprising a primary half for covering the primary reservoir and the lid comprising a secondary half for covering the secondary reservoir.

12. The sump liner according to claim 11 where the primary half defines a primary lid opening and the secondary half defines a secondary lid opening, the primary lid opening and secondary lid opening for allowing discharge pipes to pass therethrough and wherein the lid is made from materials selected from the group consisting of: plastics, injection molded plastics, thermoformed plastics, metals, and combinations thereof.

13. The sump liner according to claim 1 wherein the sump liner is formed as a unitary body.

14. The sump liner according to claim 13 wherein the sump liner is made from materials selected from the group consisting of: plastics, injection molded plastics, thermoformed plastics, metals, and combinations thereof.

15. A method of forming a sump liner comprising the acts of:

a) providing a base member;

b) providing a liner wall comprising a proximal end and a distal end, and joining the proximal end with the base member;

c) providing the liner wall with a primary reservoir portion and a secondary reservoir portion, d) extending the liner wall about the periphery of the base member, and defining a sump liner interior internal to the liner wall and the base member;

e) providing the liner wall with inside surface and an outside surface;

f) providing a weir extending from the base member and the inside surface of the liner wall at the location where the primary reservoir portion of the liner wall and the secondary reservoir portion of the liner wall meet, the weir dividing the sump liner interior into a primary reservoir and a secondary reservoir;

g) defining a cutout in the primary reservoir portion of the liner wall, the cutout leading to the primary reservoir; and h) wherein the primary reservoir is for receiving groundwater through the cutout and the secondary reservoir is for receiving groundwater that flows over the weir.

16. The method according to claim 15 further comprising the acts of:

a) providing a support surface and joining the support surface with the distal end of the liner wall, and providing the liner wall with a periphery, the support surface extending about the periphery of the liner wall;

b) defining a gutter in the support surface and extending the gutter about the periphery of secondary reservoir portion of the liner wall and beyond the weir, the gutter ending at a gutter outlet; and c) providing the gutter outlet to be in fluid communication with the primary reservoir.

17. The method according to claim 15 further comprising the acts of providing the sump liner with a lid and forming the sump liner and/or lid from a material selected from the group of materials consisting of: plastics, injection molded plastics, thermoformed plastics, metals, and combinations thereof.

18. A method of removing drainage water from a building comprising the acts of:

a) providing a sump in a floor;

b) installing a sump liner in the sump, the sump liner comprising means for keying to the floor;

c) pouring cement around the means for keying so that the sump liner is fixed to the floor;

d) providing the sump liner with a base member and a liner wall comprising proximal and distal ends, the liner wall further comprising a primary reservoir portion and a secondary reservoir portion;

e) joining the proximal end of the liner wall to the base member and extending the liner wall about the periphery of the base member, the liner wall and base defining a liner interior;

f) providing a weir and joining the weir in the sump liner at a location where primary reservoir portion and a secondary reservoir portion of the liner wall meet, the weir dividing the sump liner interior into a primary reservoir and a secondary reservoir;

g) extending the weir such that it is recessed with respect to the distal end of the sump liner;

h) providing a primary pump in the primary reservoir and providing a secondary pump in the secondary reservoir; and i) the primary pump for pumping water out of the primary reservoir, and the secondary pump for pumping water out of the secondary reservoir when water flows over the weir and flows into the secondary reservoir and activates the secondary pump.

19. The method according to claim 18 further comprising the acts of:

a) providing a support surface and joining the support surface with the distal end of the liner wall, and providing the liner wall with a periphery, the support surface extending about the periphery of the liner wall;

b) defining a gutter in the support surface and extending the gutter about the periphery of secondary reservoir portion of the liner wall and beyond the weir, the gutter ending at a gutter outlet; and c) providing the gutter outlet to be in fluid communication with the primary reservoir.

20. A system for removing water from a basement comprising:

a) a sump liner, the sump liner comprising a liner wall and a base member, the liner wall comprising a proximal end and a distal end, the proximal end of the liner wall joined with and extending from the base member, the liner wall and the base member defining a sump liner interior therein;

b) the liner wall comprising a primary reservoir portion and a secondary reservoir portion;

c) the sump liner comprising a weir positioned in the sump liner interior at the location where the primary reservoir portion and secondary reservoir portion of the liner wall meet, the weir joined with the sump liner, the weir dividing the sump liner interior into a primary reservoir and a secondary reservoir, the weir further comprising a first side which is recessed with respect to the distal end of the liner wall;

d) a primary sump pump positioned in the primary reservoir and a secondary sump pump positioned in the secondary reservoir;

e) wherein the primary reservoir portion of the liner wall defines an opening leading to the primary reservoir for allowing drainage water to flow therethrough and enter into the primary reservoir; and f) the primary pump for pumping water out of the primary reservoir and the secondary pump for pumping water out of the secondary reservoir in the event water overflows over the first side of the weir and flows into the secondary reservoir and activates the secondary pump.

21. The system according to claim 20 further comprising an inlet pipe fittable in a cutout in the liner wall for allowing drainage water to flow therethrough into the primary reservoir.

22. The system according to claim 20 wherein the liner wall further comprises an outside surface and wherein means for keying the sump liner to the basement floor extend from the outside surface of the liner wall, the means for keying for preventing hydraulic forces from lifting the sump liner.

23. The system according to claim 20 further comprising:

a) a support surface joined with the distal end of the liner wall and wherein the liner wall comprises a periphery, the support surface extending about the periphery of the liner wall; and b) wherein the support surface defines a gutter, the gutter extends about a periphery of secondary reservoir portion of the liner wall and beyond the weir and ends at a gutter outlet, the gutter outlet in fluid communication with the primary reservoir.

24. The system according to claim 20 wherein the sump liner is formed as a unitary body.

25. The system according to claim 24 wherein a lid and/or the sump liner are made of materials selected from the group of materials consisting of: plastics, injection molded plastics, thermoformed plastics, metals, and combinations thereof.

26. A sump liner comprising:

a) a base member;

b) a liner wall comprising a proximal end and a distal end, the proximal end joined with the base member;

c) the liner wall joined with and extending about the periphery of the base member, the liner wall and the base member defining a sump liner interior therein;

d) a weir, the weir positioned internal to the sump liner interior and joined with the base member and the liner wall, the weir divides the sump liner interior into a primary reservoir and a secondary reservoir;

e) wherein the liner wall further comprises a primary reservoir portion and a secondary reservoir portion, the primary reservoir portion of the liner wall defining a cutout for allowing groundwater to flow through and enter the primary reservoir, the weir for controlling the flow of water into the secondary reservoir; and f) the primary reservoir is for accommodating a primary pump therein, and the secondary reservoir is for accommodating a secondary pump therein.

27. The sump liner according to claim 26 further comprising a) a support surface joined with the distal end of the liner wall and extending about the periphery of the liner wall; and b) wherein the support surface defines a gutter extending about the periphery of secondary reservoir portion of the liner wall, the gutter extending beyond the weir and ending at a gutter outlet, the gutter outlet in fluid communication with the primary reservoir so that water in the gutter flows out the outlet and into the primary reservoir.

28. The sump liner according to claim 26 further comprising a means for elevating in the secondary reservoir, the means for elevating for raising the secondary pump located in the secondary reservoir above the surrounding base member.

29. The sump liner according to claim 28 wherein the means for elevating, the base member, the weir, and the secondary reservoir portion of the liner wall define a water basin, the water basin for collecting seepage water so that the secondary pump remains elevated above the seepage water.

* * * * *